United States Patent [19]

Hamilton

[11] 4,343,472

[45] Aug. 10, 1982

[54] GOLF PUTTER WITH ALIGNMENT SYSTEM

[76] Inventor: Thomas R. Hamilton, 12394 Maple Ave., Goodrich, Mich. 48438

[21] Appl. No.: 182,829

[22] Filed: Aug. 29, 1980

[51] Int. Cl.[3] ..... A63B 53/04

[52] U.S. Cl. ..... 273/164; 273/171; 273/183 D

[58] Field of Search ..... 273/77 R, 80 C, 163 R, 273/164, 167–175, 183 D, 193 R, 194 R; D21/219

[56] References Cited

U.S. PATENT DOCUMENTS

| | | | |
|---|---|---|---|
| D. 206,540 | 12/1966 | MacKenzie | 273/167 D X |
| D. 211,100 | 5/1968 | Baker | 273/164 X |
| D. 235,074 | 5/1975 | McCabe | 273/164 X |
| D. 245,439 | 8/1977 | Thiel | 273/163 R X |
| D. 247,585 | 3/1978 | Duclos | 273/164 X |
| 3,019,022 | 1/1962 | Ehmke | 273/163 R |
| 3,143,349 | 8/1964 | MacIntyre | 273/164 X |
| 3,667,761 | 6/1972 | Palotsee | 273/164 X |
| 3,876,211 | 4/1975 | Caligiuri | 273/164 X |
| 3,880,430 | 4/1975 | McCabe | 273/164 X |
| 3,954,270 | 5/1976 | Cook | 273/164 |
| 4,043,562 | 8/1977 | Shillington | 273/164 |
| 4,128,244 | 12/1978 | Duclos | 273/164 |
| 4,136,877 | 1/1979 | Antonious | 273/164 |

OTHER PUBLICATIONS

"Golf Digest"; Apr. 1974; p. 122; The Penny Putter.

*Primary Examiner*—Richard J. Apley
*Attorney, Agent, or Firm*—Harry R. Dumont

[57] ABSTRACT

The golf putter head includes a planar bottom and a vertical slot alignable with a lower angled painted surface to insure proper positioning of the eyes and head when setting up and executing a putt. The vertical slot and the line which one sees through it from the brightly painted surface is perpendicular to the face of the putter in the approximate center of the striking face. This line when set up with the line of the putt squares the face of the putter with the line of the putt. Thus, by grounding the club on its essentially flat bottomed surface, positioning one's head to see the line on the fluorescent surface, aligning the viewed line to the line of the putt, positioning one's body parallel to both lines, and swinging the club down the putt line, it is possible to strike almost all putts with the striking face square to the line of the putt. An alternate embodiment in place of the slot provides a single or a series of vertical holes on a line perpendicular to the putter striking face.

5 Claims, 9 Drawing Figures

FIG. 1
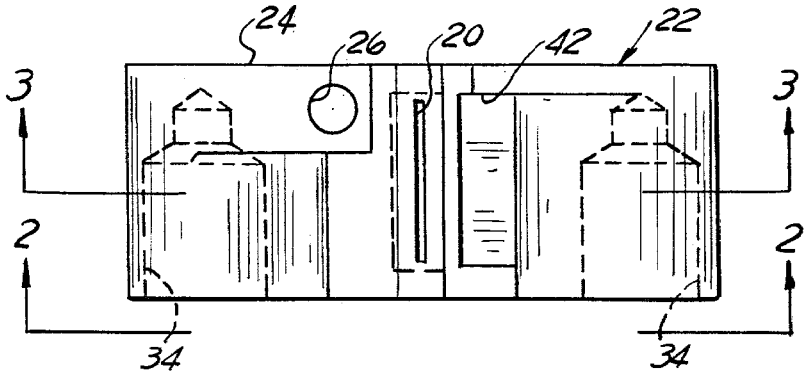
FIG.2
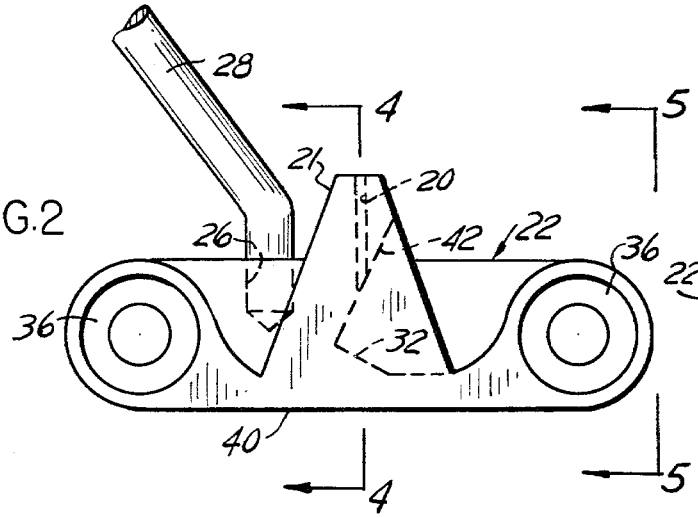
FIG.5
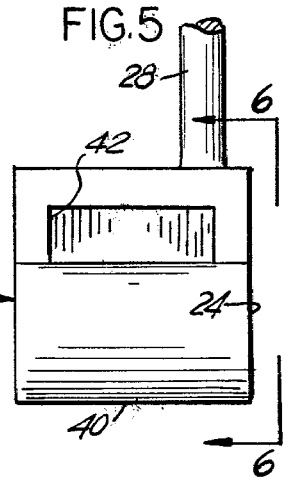
FIG.4
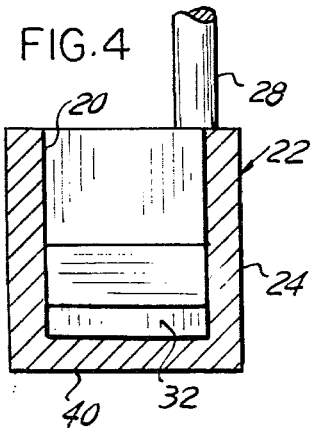
FIG.6
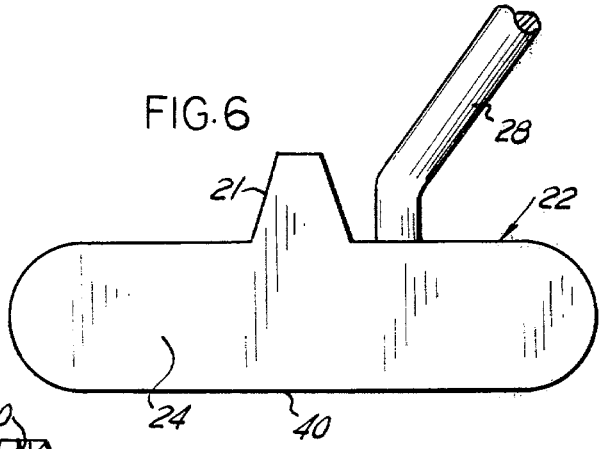
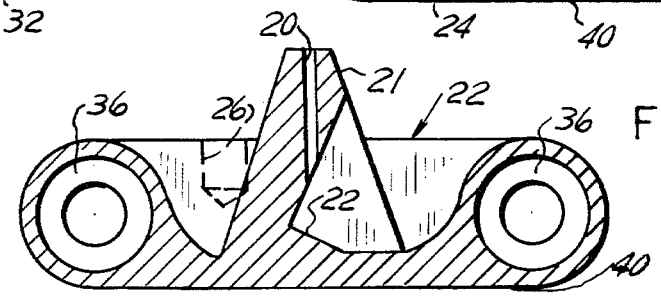
FIG.3

FIG. 7
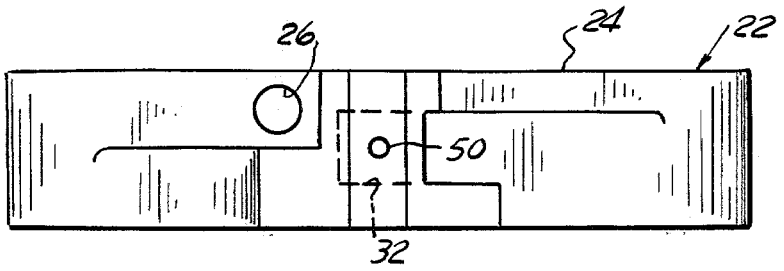
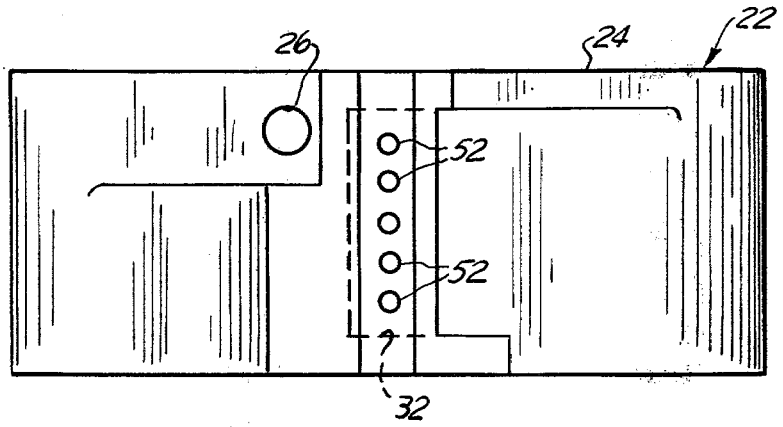
FIG. 8
FIG. 9
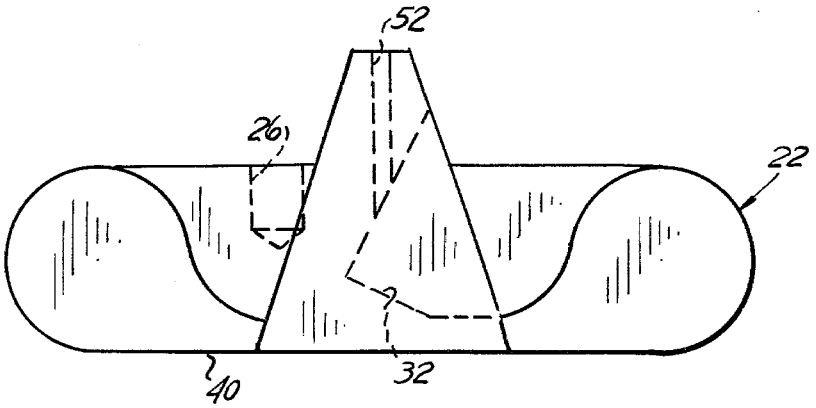

GOLF PUTTER WITH ALIGNMENT SYSTEM

BACKGROUND OF THE INVENTION

This invention is directed to an improvement in golf clubs and has particular application to the club known commonly as the putter. More specifically, the invention resides in a sighting and alignment system associated primarily with the putter head. It will become apparent to those skilled in the art that the invention may be incorporated in golf clubs other than the putter, and it may selectively be incorporated in other striking devices employed in other sports such as, for example, croquet mallets and the like.

DESCRIPTION OF THE PRIOR ART

A number of prior art devices are known in which heads of golf clubs are provided with aligning systems and sighting devices. Many of these are subject to the problem that the putter head itself is curved or rounded on its bottom surface so that any sighting system provided has little usefulness. An example of this type of head, associated with an alignment system, is shown and described in U.S. Pat. No. 3,880,430 issued on Apr. 29, 1975 to T. R. McCabe for "Golfer Club Including Indicators for Aligning Golfers Head Relative thereto".

An additional putter alignment or sighting system is shown and described in U.S. Pat. No. 4,043,562 issued on Aug. 23, 1977 to B. G. Schillington for "Putter Alignment Sight". Here again the alignment system, its operability and effectiveness are all severely limited since the putter head itself has a curved bottom which impedes and obstructs the usefulness of the sighting system itself.

A further golf club head with alignment system is shown and described in U.S. Pat. No. 1,291,967 issued to A. MacDougall for "Gold Club Head". The system there shown again is without effective operability because of the curved lower surface of the head and because of the lack of a two dimensional lineup device for the head.

A still further face aligning golf club arrangement is shown in U.S. Pat. No. 3,328,032 issued on June 27, 1967 to S. M. Griswold for "Golf Club With Face Aligning and Orienting Means". Here again the disclosed aligning system is not operative because of the curved nature of the bottom of the putter head itself and for other reasons which will become apparent because of the curved face of the striking surface.

SUMMARY OF THE INVENTION

In one embodiment of the invention, there is provided a putter having a vertical slot and a lower, spaced, angled flourescent painted surface to insure proper positioning of the eyes and head when setting up a putt. When the putter head is grounded, the only way the painted, angled surface can be seen by the putter is when he has his head positioned directly over the slot. This also means that his eyes must be positioned directly over the line of the putt.

In an alternate embodiment of the invention, either a single vertical hole alignable with a flourescently painted, angled surface can be used as a sighting aid. Alternately, a series of vertical holes falling on a line perpendicular to the putter head face and likewise alignable with a flourescently painted, angled surface may be used for sighting.

BRIEF DESCRIPTION OF THE DRAWINGS

FIG. 1 is a top plan view of a putter head with an alignment system incorporating a vertical slot;

FIG. 2 is a rear elevational view of the device of FIG. 1;

FIG. 3 is a longitudinal sectional view taken along the section line 3—3 of FIG. 1;

FIG. 4 is a cross sectional view taken along the section line 4—4 of FIG. 2;

FIG. 5 is a side elevational view taken along the line 5—5 of FIG. 2.

FIG. 6 is a side elevational view of FIG. 5 taken along the line 6—6 and showing the striking face of the putter head;

FIG. 7 is a top plan view of a putter head showing an alternate embodiment for a sighting system;

FIG. 8 is also a top plan view showing a still further embodiment of a sighting system using a plurality of vertical holes; and FIG. 9 is a rear elevational view of the device of FIG. 8 showing further details of its alignment system.

DETAILED DESCRIPTION OF THE SEVERAL EMBODIMENTS

Referring now to FIGS. 1 and 2, these show the basic structure of one embodiment of my invention in which the sighting system includes a perfectly oriented slot 20. Slot 20 is preferably a rectangular cross sectional configuration, and extends vertically through a central raised aligning portion 21 of the putter head 22. The putter head 22 includes a flat striking face 24. A socket 26 is further incorporated at the upper surface of the putter head 22 for receiving the base of a golf shaft 28. The shaft 28 is normally bent to allow for offset and to allow the golfer to lean over the putting head with an unobstructed view of it. Also shown in FIGS. 2 and 4 is the detail of the vertical slot 20 and a lower positioned angled surface 32 which preferably is painted with a flourescent paint to assist in sighting and alignment. This surface 32 is positioned at an angle to the plane of the slot.

Also included in the putter head 22 are a pair of machined out portions 34 which are used for selectively adjusting the overall weight of the putter head and capped by caps 36 as shown in FIG. 2. If it is desired to add additional weights to the putter head, this can be done by including weights in the cut out portions 34. Also shown in FIGS. 2, 4, and 6 is the flat lower surface 40 of the putter head 22. Also included in the putter head 22 is a flat top portion or planar top face parallel to the flat lower surface 40. It is important to the operation of the alignment system in my invention that the lower surface of the putter head be flat to insure the operability of the overall system. The flat surface preferably extends in a planar direction normal to the striking surface 24 of the putter head 22 and also extends throughout the bottom portion of the head 22 as best shown in FIGS. 2 and 5.

For convenience in manufacture, a central recess 42 is provided in the putter head 22 so that there is a cut out portion between the lower end of the vertical slot 20 and the slanted painted surface 32. This will allow for relative movement between the head of the golfer and the putter head 22 in making the initial alignment before putting.

FIG. 7 shows an alternate embodiment of my invention in which a single vertically oriented opening 50 is used in place of the vertical slot 20 of the FIG. 1 embodiment. The same lower painted surface 32 is provided in the putter head 22 also on a plane slanted with respect to the plane of the vertical hole 50. Thus, alignment is achieved by looking downwardly through the vertical opening 50 in substantially the same way as through the vertical slot 20. A still further embodiment of my invention essentially similar to the one shown in FIG. 7, is set forth in FIGS. 8 and 9. In this case, a plurality of vertically oriented openings 52 are used in place of the single opening 50 of the FIG. 7 embodiment. The openings 52 fall on a line perpendicular to the putter striking face 24. In a like manner, there is provided a flourescent painted reflective surface 32 below. The relative sizing between the openings 52 and the reflective surface 32 is indicated. It will be understood that basic operation of the alignment system is the same for the several embodiments of my putter head which are disclosed.

It will thus be seen that I have provided by my invention an improved putter head which incorporates the basic elements of an alignment system that virtually assures one of achieving the proper set up in putt line visualization required for properly stroking the ball. The alignment system is one easy to learn and easy to use under most field conditions.

I claim:

1. A putter head and alignment system, comprising:

a substantially flat striking face and a substantially flat rear surface;

a flat bottom portion and a flat top portion;

a central portion elevated relative to said top portion, said central portion having a front portion substantially flush with said striking face and a rear portion substantially flush with said rear surface, said central portion having at least one vertical sighting opening extending therethrough, said at least one opening lying in a plane at a right angle to the plane of said striking face, said central portion having an angled central cut-out portion thereby spacing the lower end of said opening from the bottom surface of said central portion, said bottom surface comprising a slanted, planar reflective surface that is angularly oriented with respect to said opening.

2. The combination as set forth in claim 1 wherein said reflective surface is covered with a fluorescent paint.

3. The combination as set forth in claim 1 wherein said opening is a slot having a rectangular configuration.

4. The combination as set forth in claim 1 wherein said putter head includes a pair of end portions on opposite sides of the raised central portion, each such end portion having a capped cut-out portion for weight adjustment.

5. The combination as set forth in claim 1 wherein said opening comprises a plurality of aligned and spaced apart vertically oriented openings.

* * * * *